United States Patent [19]

Hauskins, Jr.

[11] 4,122,002

[45] Oct. 24, 1978

[54] METHOD AND APPARATUS FOR ELECTROSTATICALLY SEPARATING PARTICLES FROM A MIXTURE OF PARTICLES

[76] Inventor: John B. Hauskins, Jr., 5738 N. Central Ave., Phoenix, Ariz. 85012

[21] Appl. No.: 794,828

[22] Filed: May 9, 1977

[51] Int. Cl.[2] ..... B03C 7/04

[52] U.S. Cl. ..... 209/129; 209/127 R

[58] Field of Search ..... 209/127–130, 209/111.5, 93, 71, 131; 40/28 C

[56] References Cited

U.S. PATENT DOCUMENTS

| | | | |
|---|---|---|---|
| 670,441 | 3/1901 | Sutton | 209/130 |
| 880,891 | 3/1908 | Lawson | 209/128 |
| 2,328,577 | 9/1943 | Oglesby | 209/129 X |
| 2,825,078 | 3/1958 | Bugler | 209/127 R X |
| 2,847,124 | 8/1958 | Brastad | 209/129 X |
| 3,720,312 | 3/1973 | Shok | 209/127 R X |

FOREIGN PATENT DOCUMENTS

| | | | |
|---|---|---|---|
| 71,913 | 3/1916 | Switzerland | 209/127 C |
| 28,782 of | 1912 | United Kingdom | 209/127 C |
| 143,744 | 7/1961 | U.S.S.R. | 209/131 |

*Primary Examiner*—Robert Halper
*Attorney, Agent, or Firm*—Cahill, Sutton & Thomas

[57] ABSTRACT

Small particles are separated from a mixture of particles by passing mixture through a separating chamber having upper and lower plates. The plates are connected to a potential source to establish an electric field therebetween. The particles coming in contact with the lower plate become charged and are repelled upwardly toward the upper plate. Larger particles fall under the influence of gravity back to the lower plate, while the smaller particles are repelled sufficiently close to the upper plate to be attracted thereby and thereby travel a greater vertical distance than the larger particles. A plurality of tubes extend through the lower plate and terminate a predetermined distance from the upper plate to form passageways extending from the field between the plates outwardly through the bottom plate. The smaller particles, having traveled a greater vertical distance, may then be expelled in their downward travel through the passageways. The strength of the field, the distance between the plates, and the height of the conduits, may be selected to separate particles of a given size range.

7 Claims, 2 Drawing Figures

METHOD AND APPARATUS FOR ELECTROSTATICALLY SEPARATING PARTICLES FROM A MIXTURE OF PARTICLES

The present invention pertains to particle separators, and more particularly, to a method and apparatus for electrostatically separating chargeable particles of a predetermined size range from a mixture of particles.

In past years, the availability of large quantities of low cost, high quality, mineral aggregate materials has been of paramount importance to the large construction contractors around the country. Recently, due to the large quantity of construction that has taken place, these high quality, clean mineral aggregates are becoming more difficult to locate and more expensive. It is desirable then to find a method of using materials of lower quality. These materials are normally characterized by the presence of very fine particles commonly referred to as the minus 200 mesh material. Present day specifications for material used in paving highways or making concrete for buildings, bridges, etc., requires that the presence of these minus 200 mesh materials be less than somewhere between 2 and 6 percent by weight of the total quantity of material used. Clean sand and gravel from river bottom locations have commonly been used to supply these types of materials. Unfortunately, these sources of material are no longer as easily located as they have been in the past. Large quantities of "dirty" material exist, however, which contain higher than this allowable quantity of fine particles and, if they could be economically processed to remove these particles, could be used for construction purposes. The acceptable methods of removing these particles in the past have been by screening, removal by washing, or removal by air processes.

Removal by screening is somewhat expensive due to the fact that screens which are effective for separating these small particles are of very low capacity. That is, a square foot of screen surface that would separate the 200 mesh size would be very mechanically sensitive to ripping or tearing; further, the screen would be able to process only approximately 1/10 of a ton or 100 pounds per square foot of vibrating screen per hour. This is totally unacceptable to a contractor. Therefore, to remove these fine particles, the prior art has resorted to a wasteful process which is characterized by the use of a larger mesh screen and rejecting all of the particles smaller than that. However, in some sand and gravel sources this requires rejection of perhaps 50 to 60, even sometimes 70 percent of the total quantity of the material produced. This also becomes very expensive because a much larger total quantity of material must be processed and results in a lower quality final product. This final product might be lacking some of the desirable particles 3 to 4 times larger than a 200 mesh particle.

The second method, removal by washing, is a commonly used process. However, since water is of low availability in certain areas of the country and since the new Environmental Protection Agency has promulgated regulations regulating discharge of waste waters into various streams and other locations, this method is becoming less desirable both from a cost standpoint and from an environmental pollution standpoint. In many construction areas, water is simply unavailable; in those instances, the contractor must bring water in by pipeline or by truck.

The third method, removal by air processes, has been the subject of extensive experimentation. Efficient air processors have been constructed in the past; however, these devices are very environmentally damaging. Such processors create large columns of effluent dust particles. Although it is possible to make an air processor environmentally compatible, the use of a filtering bag house would be required which is both expensive and labor intensive for maintenance purposes.

It is therefore an object of the present invention to provide a method and apparatus for inexpensively and efficiently separating electrostatically chargeable particles of a predetermined size range from a mixture of particles.

It is another object of the present invention to provide a method and apparatus for removing small particles from mineral aggregate materials without requiring air flow, screening, or washing.

It is still another object of the present invention to provide a method and apparatus to efficiently remove small particles from mineral aggregate materials without the generation of dust particles.

These and other objects of the present invention will become apparent to those skilled in the art as the description thereof proceeds.

Briefly, in accordance with the embodiment of the method and apparatus chosen for illustration, a mixture of particles is placed in contact with a plate to which an electric potential is applied; a parallel plate is positioned above the mixture and a potential of opposite polarity is applied thereto. An electric field is thus established between the two plates resulting in the charging of the particles in contact with the lower plate and the subsequent replusion of the particles therefrom. As the particles are repelled, they travel upwardly in the field. The larger particles return to the lower plate by gravity while the lighter particles continue to travel upwardly toward the upper plate. Since these particles are charged with a polarity opposite that of the upper plate, the smaller particles are attracted to the upper plate. When the smaller particles contact the upper plate, they substantially immediately become charged to the upper plate polarity and are repelled therefrom. A plurality of tubes or conduits extend through the bottom plate into the field between the plates; the tubes terminate a predetermined distance from the upper plate and provide a passageway for the expulsion of the lighter particles as they are being repelled from the upper plate.

The present invention may more readily be understood by reference to the accompanying following drawings in which.

Figure 1:
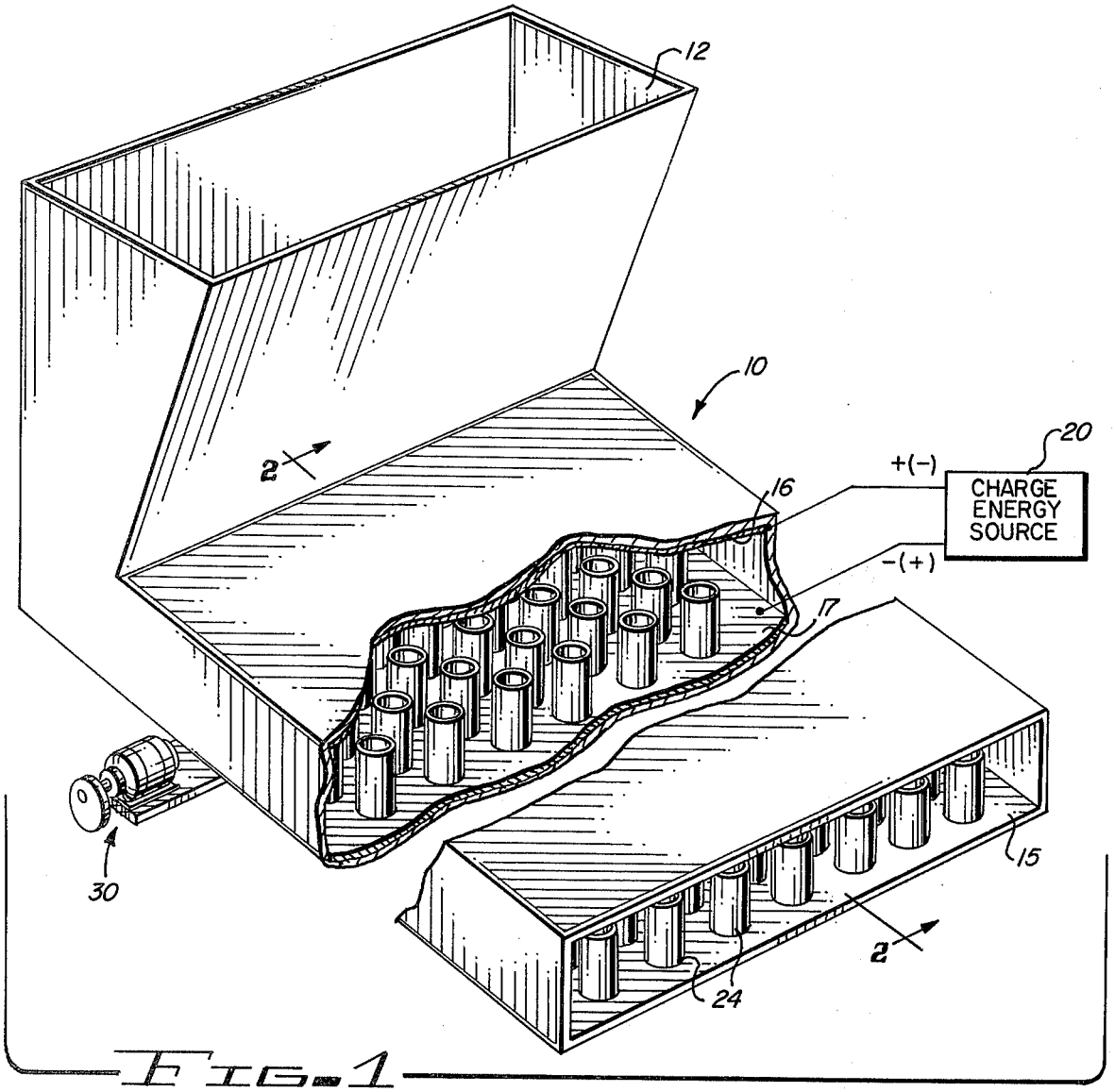
FIG. 1 is a perspective view, partly in section and partly schematic, of a particle separator constructed in accordance with the teachings of the present invention and useful in illustrating the method of the present invention.

The field of electrostatics has been explored and the relationship of forces acting on like and unlike charged particles is well known. Basically, the relationship of specific surface to the volume of a particle varies widely with variation in particle size. For instance, particles of coarse sand with particle size of approximately 1 millimeter would have 60 square centimeters of surface area per cubic centimeter of particles; whereas, particles of 0.5 millimeters or 500 microns would exhibit 120 square centimeters of surface area per cubic centimeter. Also, very fine sand in the 100 micron region or 0.1 millimeters would have 600 square centimeters of surface area per cubic centimeter of particles and silt, which would be approximately 0.05 millimeters or 50 microns, which would come under the 74 micron or minus 200 mesh area and would have approximately 1200 square centimeters of surface area per cubic centimeter of particles. Fine silt would come in the area of 0.01 millimeters or 20 microns and would exhibit about 6000 square centimeters of surface area per cubic centimeter of particles. This illustrates the wide variation of specific surface to volume in a distribution of material particles.

If a quantity of material of a constant type such as sand, which basically consists of particles of silica, is allowed to enter between a pair of vertically separated, horizontal, charged plates, the particles of silica will gravitate to the bottom plate where by contact charging they will acquire an electrostatic charge. The moment these particles are charged sufficiently, they will be repelled from the flat plate since the plate and the particles are then charged in a like polarity. This will cause the recently charged particles to move vertically away from the lower charged plate. The larger particles, due to their greater volume and smaller surface area, will be repelled less vigorously than the smaller particles. The ratio is linear. For example, if four different particles of relative radiuses 1, 2, 3 and 4 are observed, it may be seen that the ratio of charge to weight or volume, in this case (the specific gravity being constant), would be 0.789 for the particle of radius 1, 0.394 for particle of radius 2, 0.262 for the particle of radius 3, and 0.1969 for the particle of radius 4. This indicates that the repelling force will depend upon the radius linearly. That is to say, the particle of radius 1 will be repelled four times as much as a particle of radius 4.

If the voltage gradient impressed between the two plates is regulated to a certain value, the very finest particles will be repelled into the air above the bottom plate up to a point where the positive charge that they have gathered from the bottom plate will become attracted to the negative charge of the upper plate. In this case, when these particles reach a certain critical level, the attractive electrostatic force between the positively charged particle and the negatively charged upper plate will be great enough to overcome the force of gravity attracting the small particles back down to the bottom plate. These small particles will then be carried completely up to the top plate where they will contact the upper plate. Their charge will be reversed and they will be repelled once again since their charge is now the same polarity as the upper plate which they are contacting. For a small particle below a certain critical size, the attraction/repulsion action results in an oscillating motion of the particle between the plates. A particle which is slightly larger will be repelled from the lower plate but may fail to reach the certain critical height where its attractive charge to the upper plate will be great enough to overcome the attraction of gravity. In this case, the particle will not be attracted to the upper plate but will, in fact, fall back to the lower plate where it will become recharged and rerepelled up into the air again.

Referring now to the drawings, a particle separator constructed in accordance with the teachings of the present invention is shown at 10. A hopper 12 is provided for feeding particles of mixed size into a separating chamber 14; the particles that are not removed in the separating chamber travel out the exit 15 while the separated particles exit beneath the separating chamber as will be described more fully hereinafter. The separating chamber includes an upper plate 16 and a lower plate 17 forming electrodes to which is applied a suitable electric potential from a charge energy source 20. The source 20 may be any convenient high voltage source having a power rating sufficient to supply the necessary power for the rate at which the mixed material is being processed. The type of source 20 is not particularly important; indeed, the source could even be batteries (if the voltage could be made high enough). The potential from the charge energy source 20 should be D.C., although it may be possible to alternate polarity between the plates at a rate that would not interfere with the separating process. A plurality of conduits 21 extend through the bottom plate 17 into the electric field existing in the separating chamber. The conduits 21 are formed of tubular material having a circular cross-section although it would appear that the cross-section of the respective tubes is not important; further, it is believed that an oval shape might present increased performance in that less resistance to the flow of the mixed particles through the separating chamber would be present. The conduits terminate at open ends 23 to thereby form passageways 24 extending from the electric field and outwardly from the separating chamber 14 through the bottom plate 17.

The conduits 21 may be mounted directly to the plate 17 or may be rendered adjustable (for purposes to be explained later) by attaching the conduits to a mounting plate 25 positioned beneath the plate 17 in such a manner to permit the plate 25 to be adjusted in a direction indicated by the arrow 26.

Figure 2:
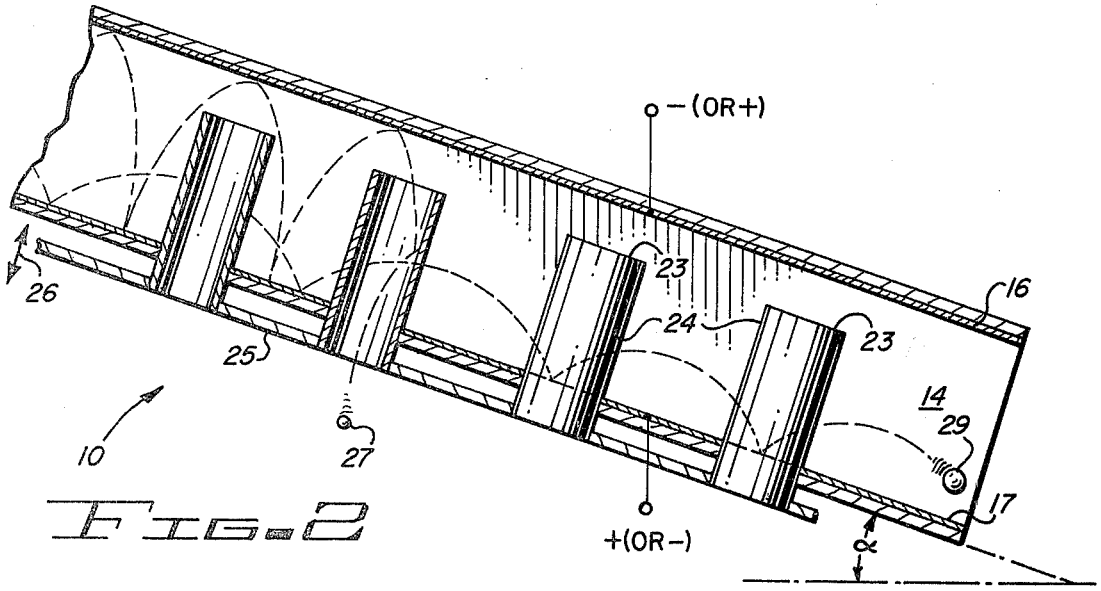
FIG. 2 is a sectional view of FIG. 1 taken along lines 2—2, and includes theoretical paths of typical particles during the separation process.

The plates 16 and 17, and the chamber 14 in which they are positioned, are inclined with respect to horizontal by an angle $\alpha$. Since the two plates 16 and 17 are inclined, the repeated repulsion and attraction of the particles cause them to follow a bouncing path from the higher to the lower end of the separating chamber 14. The smaller particles strike the upper plate 16 and are subsequently repelled therefrom while the larger particles follow a more bouncing path which may be described as saltating. A typical path for a small particle 27 is shown in FIG. 2 wherein it may be seen that the particle is repeatedly repelled from the lower plate 17, comes into the attractive influence of the oppositely charged plate 16, and is subsequently repelled downwardly to strike the lower plate 17 to repeat the repulsion/attraction steps. Each time the small particle 27 is repelled downwardly, there is a statistical probability that the particle will be propelled through the open end 23 of one of the conduits 21 and will pass outwardly from the separating chamber 14 as shown in FIG. 2. The larger particles, such as that shown at 29 in FIG. 2, will continue following their saltating path and will never reach a height above the lower plate 17 sufficient to be captured in the open ends of the conduits. Since the small particles will typically exhibit a very vigorous oscillating motion, they will have many opportunities to enter an open end of one of the conduits. Those particles which are not separated through the conduits 21, will exit the separating chamber 14 through the end of the chamber or exit 15.

The impressed voltage between the two plates, the dielectric strength of the particles being separated, the specific gravity of the particles being separated, the dielectric constant, the humidity, and the temperature have an effect on the size of particles that will be separated in the dielectric tubes. However, the size can be readily determined empirically for the specific conditions being considered. Due to the fact that dust particles which may be included in the fine particles to be separated are electrostatically charged, they are not likely to escape into the atmosphere and become an environmental hazard. The combination of repulsion and attractive forces results in a sensitive separation based on particle size. It is also possible to separate materials of different dielectric constants since small particles of one material may be repelled with greater force than similar size particles of another dielectric constant.

To facilitate the motion of the mixed particles in their migration from the upper end to the lower end of the separating chamber 14, a mechanical vibrator 30 may be added to provide low level vibration to aid in the prevention of agglomeration of the particles; the vibrator 30 may take any of several well known mechanisms including the rotating eccentric weight shown in FIG. 1.

The method and apparatus of the present invention have been found to effectively and efficiently separate small particles from mineral aggregates of the type used in the construction industry. For example, a quantity of material of mixed particle size having particle sizes less than a No. 4 mesh screen was fed into the hopper 12 of a device constructed along the lines shown in FIG. 1. The separating chamber 14 was constructed with a length of 4 feet and a width of 1 foot while the plates 16 and 17 were inclined at an angle 30° from horizontal. A 2 inch spacing was maintained between the plates 16 and 17 and a 10 Kilovolt per inch voltage gradient was established. Conduits 21 were formed of dielectric acrylic material having a 1 inch inside diameter and a 0.0625 inch wall thickness. The tubes were 2 inches in height and were extended into the separating chamber a distance of 1½ inches with the open ends 23 thereof positioned ½ inch from the top plate 16. The vibrator 30 was constructed of a 1/20 horse power motor rotating approximately 3000 rpm with a small eccentric weight attached to the shaft thereof. The vibrator is a commercially available device and induced a visually imperceptible vibrating motion to the separating chamber 14. The mixed particle size material was fed through the separator at a rate of 10 pounds per minute. It was found that the method and apparatus separated approximately 50 percent of the small particles passing a 200 mesh screen. That is, 50 percent of the small particles were removed in one pass through the apparatus.

While the apparatus was in prototype form, and was not constructed for reasons of efficiency, it was found that the power consumption, including losses in the high voltage generator, was approximately 0.0875 watts per pound of material of mixed particle size. The material used had less than 10 percent moisture content.

It may be advantageous to periodically reverse the polarity of the plates 16 and 17 to prevent electrostatic cementation of the very fine particles to the plates. The utilization of conduits having other than a circular cross-section may also be appropriate in that a more streamlined cross-section would present less impediment to the travel of the mixed particles through the separating chamber. Further, while the above described embodiment incorporated approximately 95 conduits or approximately 25 percent of the area of the bottom plate 17, the number and positioning of the conduits is not critical. It is obvious that it would be unwise to position the conduits in a pattern that would permit any portion of the mixed particles to travel through the separation chamber unimpeded; that is, the tubes should be arranged in a pattern to prevent "escape" paths for small particles throughout the width and length of the separation chamber. While the conduits or tubes may be made of substantially any dielectric material, abrasion resistance will become important when large quantities of material are to be passed through the separating chamber; therefore, some types of abrasion resistant plastics or ceramics may be advantageously used.

The apparatus described may easily be altered to vary the maximum size of the particle being separated. For example, the conduits may be extended a lesser or greater distance into the separating chamber, or the conduits may be positioned at different heights to successively separate larger maximum size particles as the mixture proceeds through the separating chamber. Similarly, the upper and lower plates may be positioned convergently or divergently to vary the field strength along the length or width of the separating chamber.

I claim:

1. A particle separator for separating predetermined electrostatically chargeable particles from a mixture of particles comprising:

(a) an upper plate forming a first electrode;

(b) a lower plate, forming a second electrode, spaced from said first electrode;

(c) means for applying a charging potential to said electrodes to form a voltage gradient therebetween;

(d) means defining a plurality of spaced apart conduits each extending through said lower plate into the space between said plates, each conduit forming a passageway, for particles being repelled from said upper plate, extending from said space through said lower plate and having an open end positioned a predetermined distance above said lower plate and below said upper plate; and (e) means for passing said mixture of particles between said plates in contact with said lower plate between said spaced apart conduits;

whereby, said predetermined electrostatically chargeable particles are alternately attracted and repelled to and from said plates and are expelled from between said plates through said conduits.

2. The combination set forth in claim 1 wherein said predetermined electrostatically chargeable particles are within a predetermined particle size range.

3. The combination set forth in claim 1 wherein said upper and lower plates are parallel to each other and are inclined with respect to horizontal.

4. The combination set forth in claim 1 including means for varying the distance of said open ends of said conduits from said upper plate to change the range of particle sizes being separated from said mixture.

5. The combination set forth in claim 1 wherein all of said open ends of said conduits are positioned the same predetermined distance from said upper plate.

6. The combination set forth in claim 3 including means for mechanically vibrating said plates to induce motion of said mixture of particles along said inclined lower plate.

7. A method for separating predetermined electrostatically chargeable particles from a mixture of particles comprising steps of:

(a) passing said mixture of particles through an electric field between two vertically separated plates, having opposite potentials thereon, in contact with the lower of said plates to cause repulsion of said particles from said lower plate;

(b) adjusting said potentials to cause the predetermined electrostatically chargeable particles in said mixture of particles to be repelled from said lower plate and travel to said upper plate and then be repelled downwardly therefrom; and (c) intercepting said predetermined electrostatically chargeable particles as they are repelled downwardly from said upper plate and directing them out of said electric field through said lower plate while continuing to pass said mixture of particles through said electric field in contact with said lower plate.

* * * * *